US005918671A

United States Patent [19]

Bridges et al.

[11] Patent Number: 5,918,671

[45] Date of Patent: Jul. 6, 1999

[54] SKATE ROLLER BEARING FOR COILED TUBING

[75] Inventors: Willard P. Bridges, Fort Worth; Mark Allan Crosby, Keller, both of Tex.

[73] Assignee: Willard P. Bridges d/b/a Coiled Tubing Products, Forth Worth, Tex.

[21] Appl. No.: 08/962,609

[22] Filed: Oct. 31, 1997

[51] Int. Cl.[6] ..... E21B 19/08; E21B 19/22

[52] U.S. Cl. ..... 166/77.3; 166/85.5

[58] Field of Search ..... 166/77.3, 85.5, 166/77.1, 77.2

[56] References Cited

U.S. PATENT DOCUMENTS

| | | | |
|---|---|---|---|
| 4,265,304 | 5/1981 | Baugh | 166/77 |
| 4,585,061 | 4/1986 | Lyons, Jr. et al. | 166/77 |
| 4,621,403 | 11/1986 | Babb et al. | 29/433 |
| 4,673,035 | 6/1987 | Gipson | 166/77 |
| 4,923,005 | 5/1990 | Laky et al. | 166/55 |
| 4,949,791 | 8/1990 | Hopmann et al. | 166/378 |
| 4,986,360 | 1/1991 | Laky et al. | 166/351 |
| 5,002,130 | 3/1991 | Laky | 166/351 |
| 5,094,340 | 3/1992 | Avakov | 198/626.1 |
| 5,133,405 | 7/1992 | Elliston | 166/77 |
| 5,188,174 | 2/1993 | Anderson, Jr. et al. | 166/77 |
| 5,309,990 | 5/1994 | Lance | 166/77 |
| 5,467,825 | 11/1995 | Vallet | 166/379 |
| 5,515,925 | 5/1996 | Boychuk | 166/379 |
| 5,515,926 | 5/1996 | Boychuk | 166/379 |
| 5,553,668 | 9/1996 | Council et al. | 166/77.3 |
| 5,566,764 | 10/1996 | Elliston | 166/385 |
| 5,575,332 | 11/1996 | Wasterval, Jr. et al. | 166/77.1 |

*Primary Examiner*—Frank S. Tsay
*Attorney, Agent, or Firm*—Geoffrey A. Mantooth

[57] ABSTRACT

An injector for flexible tubing has endless drive conveyors on opposite sides of a pathway for the tubing. The drive conveyors include gripper blocks that work in opposing pairs along the tubing pathway. The pairs of gripper blocks are clamped to the tubing and moved along the tubing pathway to either inject the tubing into a well or withdraw the tubing from a well. The gripper blocks are clamped to the tubing by way of skates, which work in opposing pairs. The skates have rollers, with rollers contacting the gripper blocks. Each roller has two ends, which ends are received by bearings inside of mounts on the respective skate.

6 Claims, 5 Drawing Sheets

SKATE ROLLER BEARING FOR COILED TUBING

FIELD OF THE INVENTION

The present invention relates to injectors for coiled or reeled tubing, such as are used in oil and gas wells.

BACKGROUND OF THE INVENTION

Coiled or reeled tubing equipment is used in the oil and gas industry to work over existing wells. In addition, the equipment is used to drill new wells.

Coiled tubing equipment utilizes a long flexible tube. When not in use, the tubing is stored on a reel on the surface. To use the tubing, it is unwound from the reel and inserted into the well. The device that inserts the tubing into, and also removes the tubing from, the well is known in the industry as an injector.

When a length of tubing is in the well, the injector supports the tubing by a series of gripper blocks. The gripper blocks operate in pairs. Each pair has diametrically opposed gripper blocks which receive the tubing therebetween. To grip the tubing, the paired gripper blocks are forced together to clamp to the tubing. To inject the tubing into the well, the gripper blocks are moved downwardly toward the earth. To retract the tubing from the well, the gripper blocks are moved upwardly away from the earth.

The gripper blocks are forced together by skates. While the gripper blocks are able to move in a vertical direction, the skates are generally immobile in the vertical direction. The skates are therefore provided with rollers that contact the moving gripper blocks.

In prior art injectors, the skate rollers are mounted onto a fixed shaft by way of bearings that are positioned along a center line of the load. The bearings are located inside of the skate roller and consequently bear the entire load. The bearings can be a single bearing, with two sets of rollers, or two bearings, each with a single set of rollers.

A problem arises when the gripper blocks become misaligned. The gripper blocks are coupled to a chain, which chain moves the gripper blocks. The chain frequently becomes misaligned. This increases the load on the bearings, resulting in a bearing failure. When one skate roller bearing fails, the load on the other skate roller bearings increase. This in turn lead to multiple failures, requiring overhaul of the injector.

With the prior art design, an injector can be used for about one million feet of tubing before the bearings fail. If the injector is used on 25,000 feet deep wells, the injector can only be used on about 20 wells before the bearings need to be replaced. A typical injector may have 40–50 rollers. Replacing the bearings is therefore a time consuming and expensive task.

SUMMARY OF THE INVENTION

It is an object of the present invention to provide an injector with skate rollers that have a higher reliability and life than existing skate rollers.

It is a further object of the present invention to provide a bearing arrangement for skate rollers that more evenly distributes the load.

The apparatus of the present invention injects and withdraws a length of flexible tubing into and from a well. The apparatus includes a pathway that is structured and arranged to receive the length of tubing. The apparatus also includes endless drive conveyors on opposite sides of the pathway. Each of the drive conveyors comprises at least one chain. Each of the chains has coupled thereto a plurality of gripper blocks. Each of the gripper blocks has a first side and a second side. The first side of the gripper blocks has a groove therein for receiving the tubing. The gripper blocks are on opposite sides of the pathway and are moveable in a direction that is along the pathway, as well as in a direction that is perpendicular to the pathway. Skates are located on opposite sides of the pathway, with the gripper blocks interposed between the skates and the pathway. Each of the skates is moveable in a direction that is perpendicular to the pathway.

Each of the skates has rollers, with each of the rollers having two ends and a central portion between the ends. The central portion is cylindrical and is structured and arranged to contact the second sides of the gripper blocks. Each end is coupled to the respective skate by a bearing.

With the apparatus of the present invention, the rollers are supported on skates at the ends of the rollers. Thus, when the skates are closed in order to force the gripper blocks onto the tubing running through the injector, the force is transmitted from the roller to the skate not at a centered set of bearings, as in the prior art, but at the ends of the rollers. This bearing arrangement reduces the load on the bearings, resulting a longer life of the rollers.

In accordance with one aspect of the present invention, the drive conveyors each comprise two endless chains, with the respective gripper blocks being interposed between the two chains. The distance between the bearings on the roller ends is the same as or greater than the distance between the chains.

In still another aspect of the present invention, the apparatus has a frame, a drive and idler members rotatably coupled to the frame. The endless drive conveyors extend between the drive members and the idler members. The idler members are rotatably coupled to a tensioner frame assembly that is slideably coupled to the frame. The tensioner frame assembly is moveable with respect to the drive members by way of a single hydraulic cylinder on each side of the drive conveyors. Because only a single cylinder on each side is used to tension the idler sprockets, as opposed to two cylinders as used in the prior art, a cost savings in manufacturing the injector is realized.

DESCRIPTION OF THE PREFERRED EMBODIMENT

Figure 1:
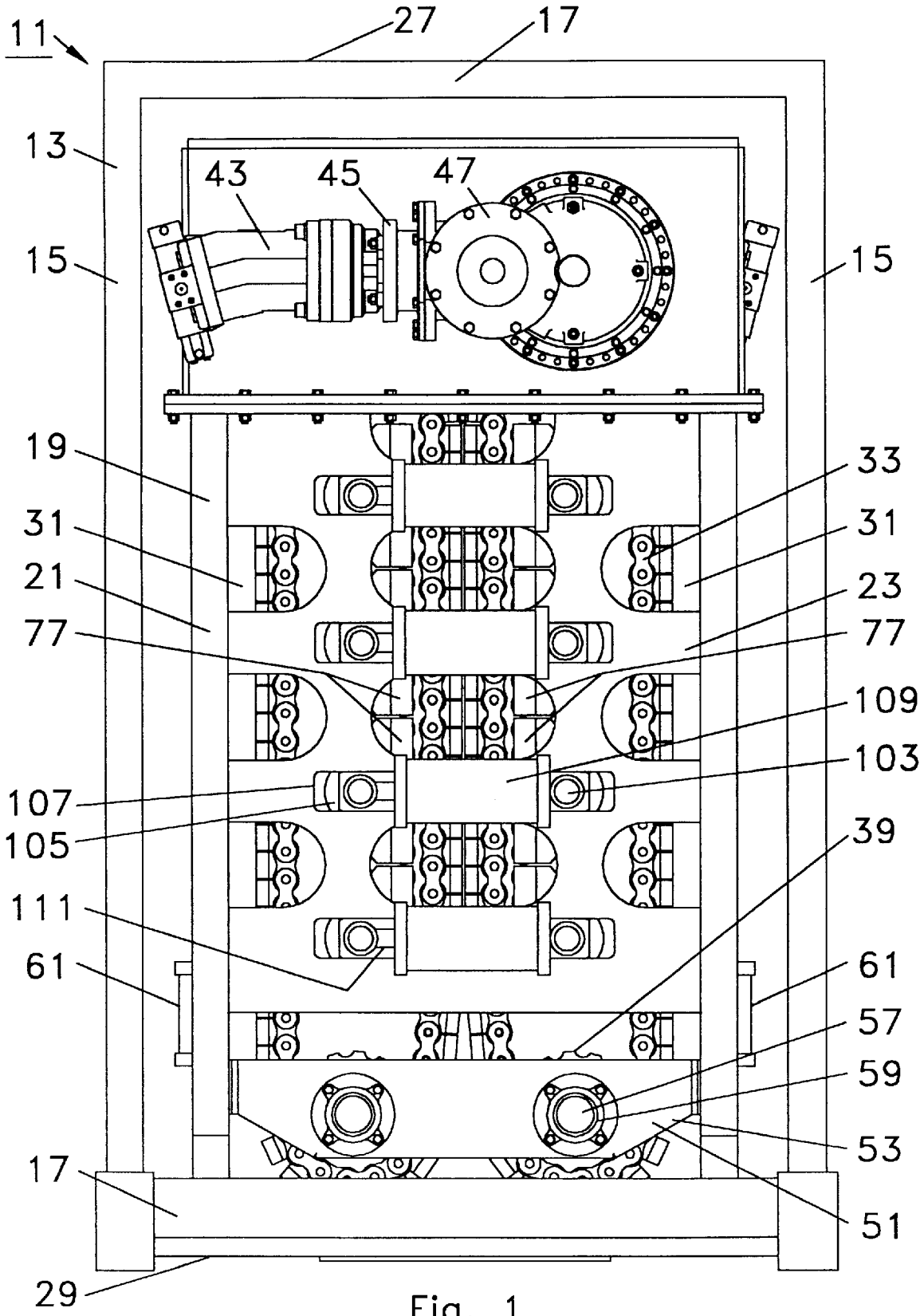
FIG. 1 is a front elevational view of the injector of the present invention, in accordance with a preferred embodiment.

In FIG. 1, there is shown an injector 11 for coiled flexible tubing, in accordance with a preferred embodiment of the invention. The injector 11 is part of a coiled tubing apparatus. Such an apparatus is shown and described in U.S. Pat. No. 4,585,061, the disclosure of which is incorporated herein by reference. Coiled tubing is used in work overs on existing wells. For example, the tubing is used in clean outs and to set downhole tools such as packers. In addition, coiled tubing is used to drill wells. A mud motor is provided at the end of the tubing. Mud pumped down inside of the tubing actuates the mud motor and rotates the bit.

Figure 2:
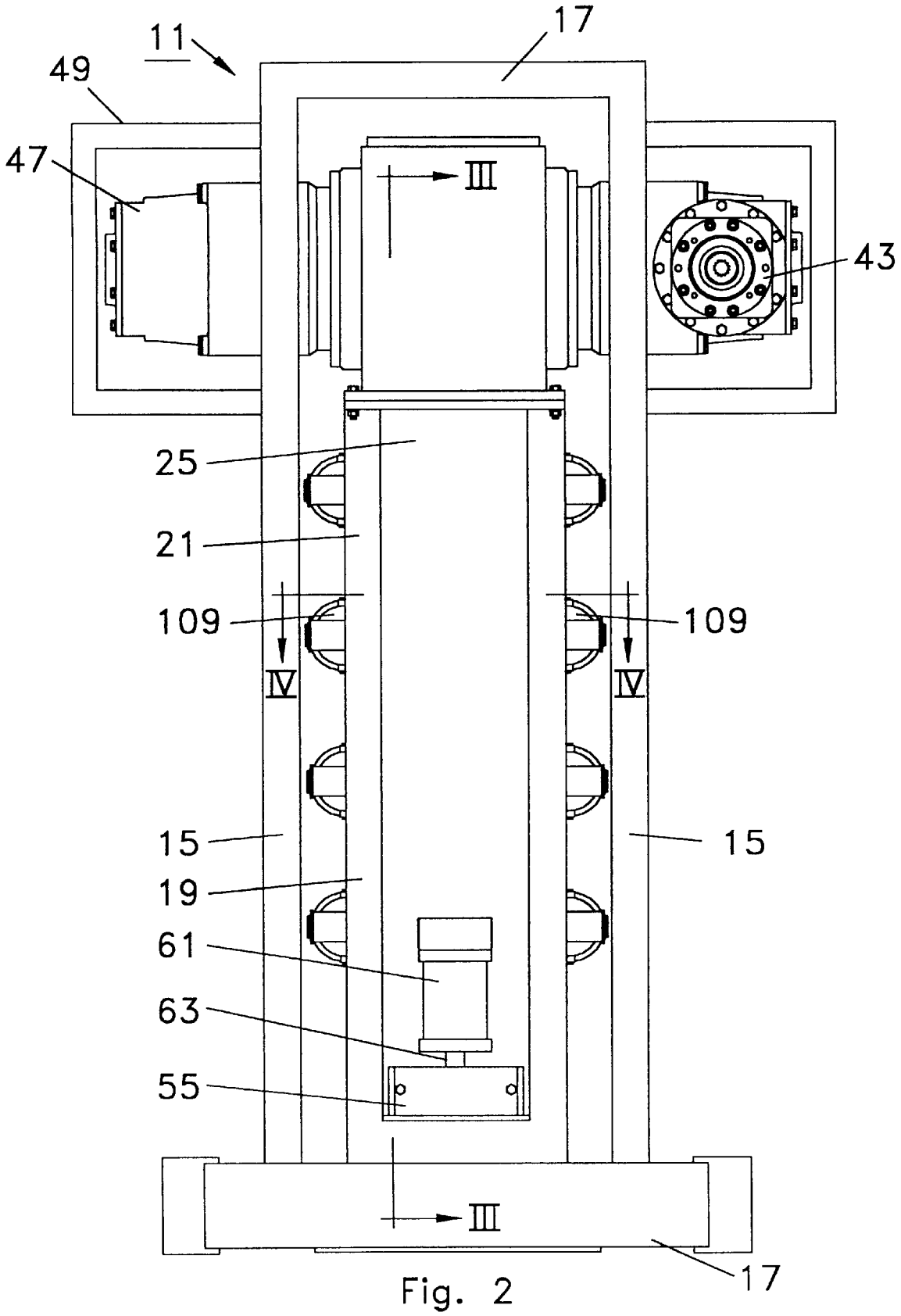
FIG. 2 is a side elevational view of the injector.

Referring to FIGS. 1 and 2, the injector 11 has a generally rectangular outside frame 13. The outside frame 13 includes four columns 15 that are connected together at their ends by beams 17. In general use of the injector, the columns 15 are oriented vertically, and the beams 17 are oriented horizontally. The outside frame 13 enables the injector 11 to be transported as a unit from well site to another.

There is also an inside frame 19 that is generally rectangular and that includes four columns 21. The columns 21 are coupled together by plates 23, 25. There are front and back plates 23 (FIG. 1 shows the front plate) and side plates 25 (FIG. 2 shows a side plate). The inside frame 19 is coupled to the outside frame 13 at the top and bottom of the frames 13, 19.

The frames have top and bottom ends 27, 29. The ends are open to allow the tubing to pass therethrough. The inside frame 19 contains two sets 31 of endless drive conveyors (see FIGS. 1 and 3). The two sets 31 are juxtaposed adjacent to each other. Each set has a pair of endless chains 33. Between the chains 33 are a plurality of gripper blocks 35 (see FIG. 4). The gripper blocks contact the tubing. The gripper blocks will be described in more detail hereinafter.

Figure 3:
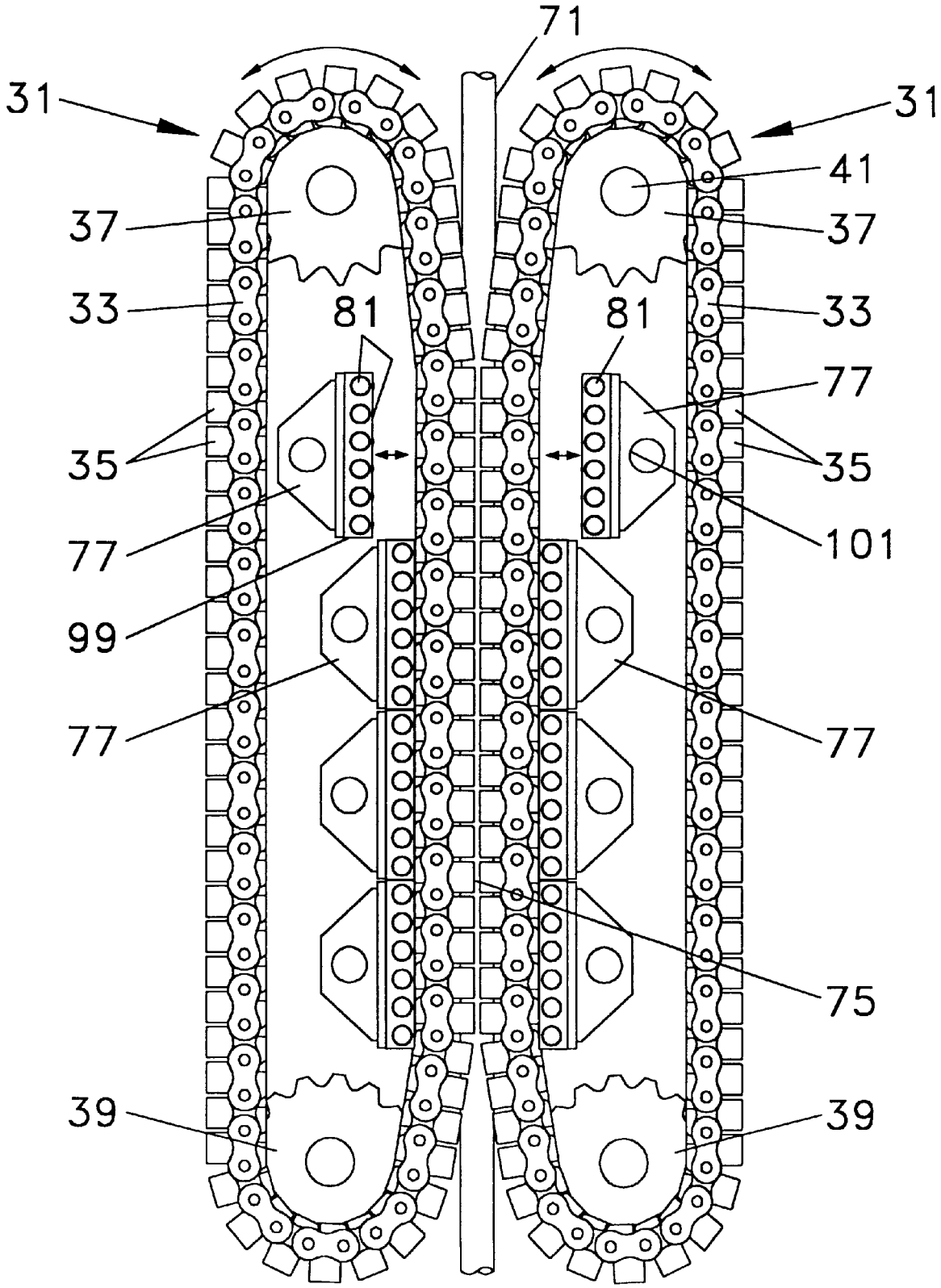
FIG. 3 is a front elevational view of the endless drive chains, as viewed from lines III—III of FIG. 2.

Each pair of chains 33 in a set is looped around a drive sprocket 37 (FIG. 3) and an idler sprocket 39. The two chains 33 in a set 31 are driven together by the drive sprocket 37. Each of the drive sprockets 37 are mounted on a shaft 41 that is in turn journaled to the inside frame 19 by way of bearings. The drive sprockets 37 are thus rotatably coupled to the inside frame 19. In FIG. 3, two types of sprockets are shown. The drive sprockets 37 have longer teeth than do the idler sprockets 39. The drive and idler sprockets can be either type. It is believed that the longer tooth type of sprocket has less wear on the chains 33, while the shorter tooth type of sprocket has less grip on the chains.

The drive sprocket has two groups of teeth, one group for each chain in the set. The two drive sprockets for the two sets of chain conveyors are positioned relative to each other. The teeth of each of the drive sprockets are coplanar with the teeth of the other of the drive sprockets. The two shafts 41 are parallel to each other and are mounted perpendicularly to the front and back plates 23 of the inside frame.

Each of the two drive sprockets 37 is rotated by a hydraulic motor 43 (see FIGS. 1 and 2). The motor 43 is connected to the respective drive sprocket by a brake 45 and a gear box 47. The motors 43 are typically mounted on opposite sides of the injector 11. The gear boxes 47 are right angle gear boxes. Drive assembly frames 49 (FIG. 2) provide support for the motor 43, the brakes 45, and the gear boxes 47.

The idler sprockets 39 are suspended by the chains 33 below the drive sprockets 37. Referring to FIG. 1, the idler sprockets 37 are rotatably connected to a floating tensioner frame 51. The tensioner frame 51 is generally rectangular in shape, having front and back horizontal beams 53 joined together at their ends by side horizontal beams 55 (FIG. 2). The idler sprockets 39 are rotatably mounted to the frame 51 by way of shafts 57 and bearings 59. A single frame 51 serves all of the idler sprockets 39.

The corners of the floating tensioner frame 51 slideably engage the columns 21 of the inside frame 19, so as to move up and down therein. For example, the columns 21 are provided with T slots or dovetail slots that receive the corners of the frame 51. The floating tensioner frame 51 provides tension to the chains 33. The tension is adjustable through the use of hydraulic cylinders 61 (see FIGS. 1 and 2). Each hydraulic cylinder 61 is coupled to a respective side plate 25 of the inside frame 19. There is a hydraulic cylinder 61 on each side of the inside frame 19. Each cylinder 61 has a piston rod 63 that extends downwardly, where it forms a connection to the side beam 55 of the tensioner frame. The hydraulic cylinders are centered between imaginary planes extending from the chains 33. Thus, only one cylinder 61 per side of the frame need be used. This is less costly than prior art injectors, which use two cylinders on each side of the frame to provide chain tension.

To provide tension to the chains 33, the hydraulic cylinders 61 extend the piston rods 63 so as to push down on the tensioner frame 51. To relieve tension on the chains, the hydraulic cylinders retract the piston rods to allow the frame 51 to move up.

Figure 4:
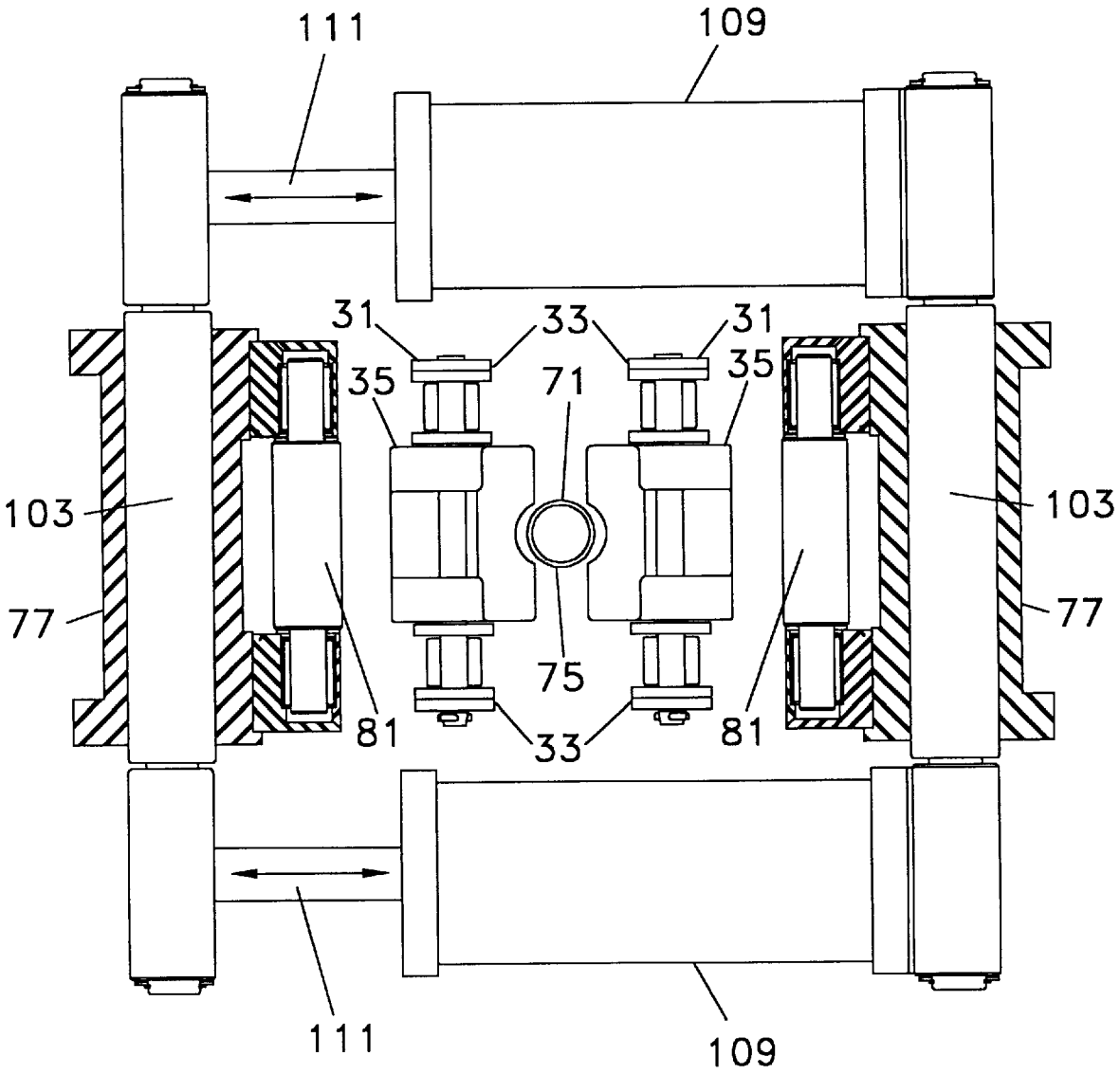
FIG. 4 is a cross-sectional view of a pair of gripper blocks and skates, taken through lines IV—IV of FIG. 2.
Figure 5:
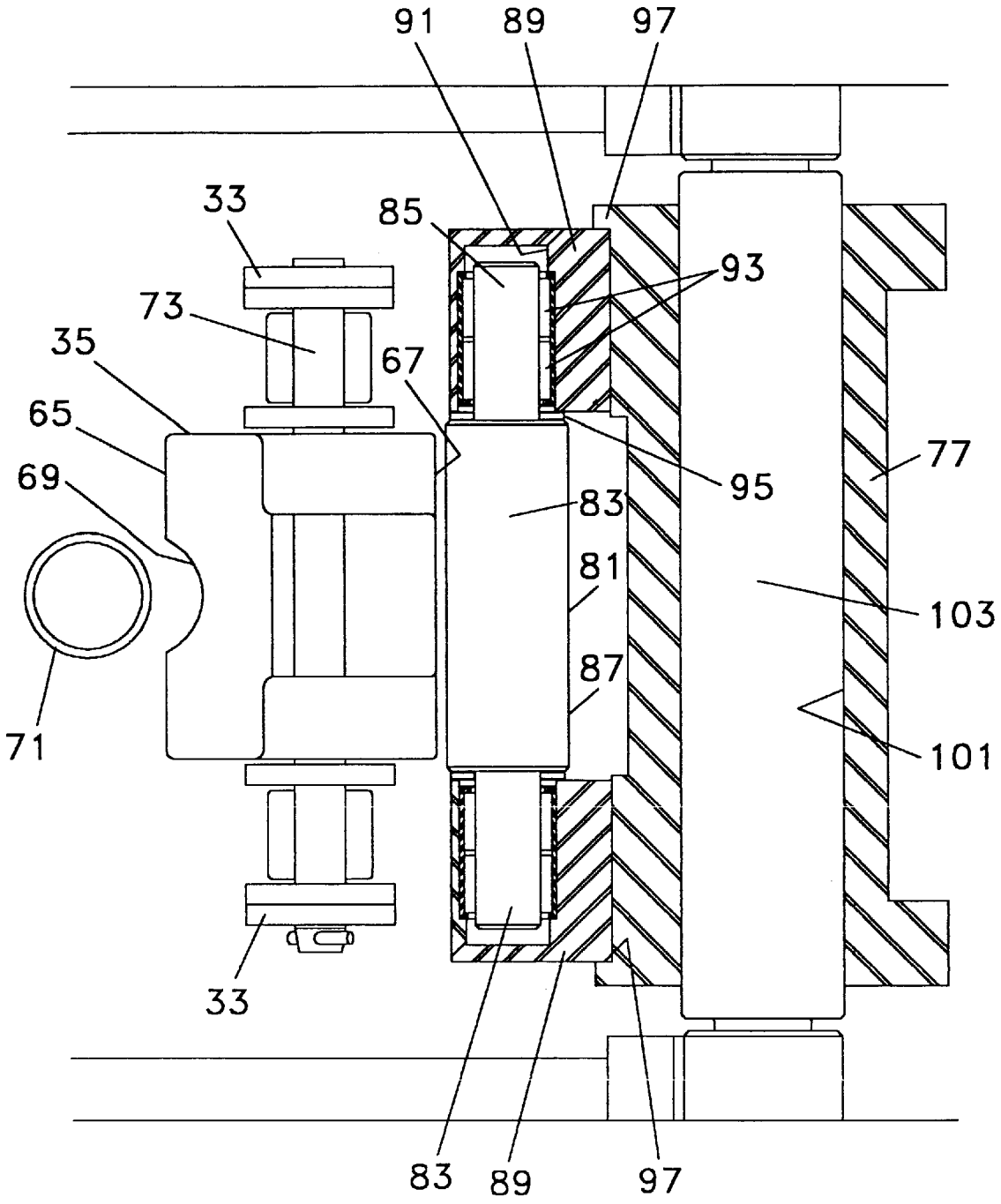
FIG. 5 is a close up view of a gripper block and skate assembly.

Referring to FIGS. 4 and 5, the gripper blocks 35 are conventional. Each gripper block has first and second sides 65, 67. The first side 65 has a semicircular groove 69 therein for receiving a short length of the tubing 71. The second side 67 has a flat surface for contacting a skate 77, as will be described hereinafter. Each gripper block is interposed between the two chains 33 in a conveyor set 31. The gripper blocks are secured to the chains by way of pins 73. The pins 73 also serve to connect the lengths of the chains together. The pins 73 are retained in the chains by heads, cotter pins and/or interference fits.

The second side 67 of each gripper block has notches at therein so as to form a inverted "Y". The "Y" has a stem and a fork connected to the stem. The stem of one gripper block is received between the fork of the adjacent gripper block. Thus, the gripper blocks are coupled together with their "Y" arrangements, which arrangements allow the gripper blocks to rotate about the pins 73 and still be coupled together. The gripper blocks can be secured to the chains 33 with one or two pins 73.

The gripper blocks, when secured to the chains, form a near continuous semi-cylindrical channel along the tubing pathway 75. In addition, the gripper blocks form a near continuous surface along the second sides, for contacting the rollers in the skates.

The chain sets 31 are juxtaposed together so as to form a tubing pathway 75 between the two chain sets. The tubing 71 is moved along the tubing pathway 75 by the injector 11, and more specifically, by the chain sets 31. The gripper blocks 35 of one chain set are aligned with the gripper blocks of the other chain set along the tubing pathway. For example, at any given point along the tubing pathway, a gripper block of one chain set is diametrically opposed across the tubing pathway 75 by a gripper block of the other chain set. The gripper blocks 35 that are positioned along the tubing pathway form a near cylindrical channel that receives a length of the tubing. Thus, the groove 69 of a gripper block in one chain set is opposed on the other side of the tubing pathway by a groove of a gripper block in the other chain set. Each gripper block in a given chain set is adjacent to and interposed between two other gripper blocks of the same chain set. In this manner, a channel is formed by the grooves along the tubing pathway.

The gripper blocks 35 can be moved along two axes simultaneously. One axis extends along the tubing pathway. This axis is typically vertical in orientation. The other axis is perpendicular to the tubing pathway 75.

The gripper blocks 35 are moved along the tubing pathway 75 in order to inject or withdraw the tubing from the well. To move the gripper blocks, the motors 43 rotate the drive sprockets 37. Both drive sprockets 37 are rotated together and at the same speed in order to maintain the alignment between the gripper blocks of one chain set with the gripper blocks of the other chain set. The drive sprockets are rotated in opposite directions with respect to each other so that the gripper blocks 35 all move in the same direction along the tubing pathway 75.

The gripper blocks 35 can also be moved short distances in a direction that is perpendicular to the tubing pathway in order to grip the tubing with more or less force. Skates 77 are used to move the gripper blocks 35 toward and away from the tubing pathway 75. To grip the tubing with more force, the gripper blocks are moved toward the tubing. To grip the tubing with less force, the gripper blocks are moved away from the tubing.

Each chain set 31 has a set of skates 77. In the preferred embodiment, shown in FIG. 3, there are four skates for each chain set. The skates work in pairs, with the skates in a pair moving in opposition to each other. The skates in a pair are mechanically coupled together with hydraulic cylinders 109.

Each skate 77 has a plurality of rollers 81. In the preferred embodiment shown in FIG. 3, each skate is shown has having six rollers 81. Referring to FIG. 5, each roller 81 has a central portion 83 located between two ends 85. The central portion 83 has a cylindrical surface 87 that is structured and arranged to contact the second side 67 of the gripper blocks 35. The ends 85 of each roller are reduced slightly in diameter from the cylindrical surface 87.

Each roller end 85 is supported by a mount 89 that is in turn coupled to the skate 77. The mounts 89 are blocks having a cylindrical bore 91 therein. The bore 91 receives an end 85 of the roller 81, as well as bearings 93 that are between the roller end and the mount. In the preferred embodiment, the bearings 93 are roller bearings and each end 85 has two such bearings. Thus, the roller 81 can rotate relative to the mounts 89. The outside diameter of the cylindrical surface 87 is larger than the inside diameter of the bore 91. A washer 95, or shim, having an outside diameter that is greater than the inside diameter of the bore, is located around each end 85, between the central portion 93 of the roller and the mount 89.

The mounts 89 are prevented from moving along the roller's axis of rotation by shoulders 97 on the skate 77. Each roller is prevented from moving along its own axis of rotation by the central portion 83 and the washers 95.

The mounts 89 are coupled to the skates 77 by way of bolts 99 (FIG. 3). The skates 77 have cylindrical bores 101 therethrough. Each bore 101 receives a pin 103. Each end of the pin 103 passes through a block 105. Each block 105 is located in a slot 107 in either the front or back plates 23 of the inside frame 19. The blocks 105 can move horizontally in the slots 107, but are constrained from moving vertically. The ends of the pins 103 are coupled to hydraulic cylinders 109 and their respective piston rods 111. For example, referring to the orientation of FIG. 4, the front end of the left skate pin is coupled to the front piston rod, while the front end of the right skate pin is coupled to the front hydraulic cylinder. Likewise, the rear end of the left skate pin is coupled to the rear piston rod, while the rear end of the right skate pin is coupled to the rear hydraulic cylinder.

The front and back hydraulic cylinders 109 work together, extending the piston rods 111 simultaneously and likewise retracting the piston rods simultaneously. Because each end of the hydraulic cylinder arrangement moves with respect to the inside frame 19, each skate 77 exerts the same force as the other, opposite skate. As the two piston rods retract, the skate 77 contact the second sides 67 of the respective gripper blocks 35. This in turn causes the gripper blocks to clamp onto a length of tubing 71. The rollers and the skates contact the second sides of the gripper blocks. Consequently, the gripper blocks can move up and down with respect to the skates. To lessen the clamping force exerted by the gripper blocks on the tubing, the piston rods extend. This allows the skates to separate, thereby allowing the gripper blocks in a pair to separate.

The skate rollers 81 of the present invention are less susceptible to failure than prior art skate rollers. Each roller 81 is supported at each end by bearings 93. Consequently, each bearing is subjected to only half what the total load of the bearing, compared with prior art rollers. This allows the rollers to have a longer service life, and makes the injector more reliable.

The hydraulic cylinders 61, 109 are provided with a power unit (not shown) to provide pressurized hydraulic fluid. The cylinders 61, 109 can be manually controlled from a control panel. In addition, the cylinders can be controlled automatically. Likewise, the motors 43 are controlled from a control panel and are powered by a hydraulic power unit.

The foregoing disclosure and the showings made in the drawings are merely illustrative of the principles of this invention and are not to be interpreted in a limiting sense.

We claim:

1. An apparatus for injecting and withdrawing a length of flexible tubing into and from well, comprising:

a) a pathway structured and arranged to receive the length of tubing;

b) endless drive conveyors on opposite sides of the pathway, each of the drive conveyors comprising at least one chain, each of the chains having coupled thereto a plurality of gripper blocks, each of the gripper blocks having a first side with a groove therein for receiving the tubing and having a second side, there being gripper blocks on opposite sides of the pathway, the gripper blocks being moveable in a direction that is along the pathway, the gripper blocks also being in moveable in a direction that is perpendicular to the pathway;

c) skates located on opposite sides of the pathway, with the gripper blocks being interposed between the skates and the pathway, each of the skates being moveable in a direction that is perpendicular to the pathway;

d) each of the skates having rollers, with each of the rollers having two ends and a central portion between the ends, the central portion being cylindrical and being structured and arranged to contact the second sides of the gripper blocks, each end being coupled to the respective skate by a bearing.

2. The apparatus of claim 1, wherein:

a) each of the drive conveyors comprising two endless chains, the respective gripper blocks being interposed between the two chains;

b) the distance between the bearings on the roller ends being the same as or greater than the distance between the chains.

3. The apparatus of claim 1 wherein the second sides of the gripper blocks are flat.

4. The apparatus of claim 1 wherein the bearings are roller bearings.

5. An apparatus for injecting and withdrawing a length of flexible tubing into and from a well bore, comprising:

a) a frame;

b) drive members rotatably coupled to the frame;

c) idler members rotatably coupled to the frame;

d) one or more motors coupled to the drive members so as to rotate the drive members;

e) two endless drive conveyors located with respect to each other so that a portion of one of the conveyors is adjacent to a portion of the other of the conveyors, each of the conveyors extending between respective ones of the drive members and respective ones of the idler members;

f) each of the conveyors having gripper blocks structured and arranged for contacting tubing located between the adjacent conveyor portions;

g) skates arranged in oppositely working pairs along the adjacent conveyor portions such that the adjacent conveyor portions are interposed between the skates;

h) each of the skates having at least one roller therein, with each of the rollers having two ends and a central portion between the ends, the central portion being cylindrical and structured and arranged to contact the gripper blocks, each end of the rollers being coupled to the respective skate by a bearing.

6. The apparatus of claim 5, further comprising:

a) the idler members are rotatably coupled to a tensioner frame assembly that is slideably coupled to the frame;

b) the tensioner frame assembly being moveable with respect to the drive members by way of a single hydraulic cylinder on each side of the drive conveyors.

* * * * *